US007926230B2

(12) United States Patent
Yoshida et al.

(10) Patent No.: US 7,926,230 B2
(45) Date of Patent: Apr. 19, 2011

(54) BRACKET STRUCTURE FOR EXTERNAL WALL AND EXTERNAL WALL CONSTRUCTION STRUCTURE

(75) Inventors: Norihiro Yoshida, Nagoya (JP); Shin Takami, Nagoya (JP)

(73) Assignee: Nichiha Corporation, Nagoya-Shi (JP)

( * ) Notice: Subject to any disclaimer, the term of this patent is extended or adjusted under 35 U.S.C. 154(b) by 434 days.

(21) Appl. No.: 12/007,253

(22) Filed: Jan. 8, 2008

(65) Prior Publication Data

US 2008/0296451 A1 Dec. 4, 2008

(30) Foreign Application Priority Data

May 31, 2007 (JP) ..... 2007-004075 U
May 31, 2007 (JP) ..... 2007-004076 U

(51) Int. Cl.
*E04B 1/10* (2006.01)

(52) U.S. Cl. ..... 52/235; 52/506.05

(58) Field of Classification Search ..... 52/287.1, 52/288.1, 698, 235, 506.05; 248/231.91, 248/345.1

See application file for complete search history.

(56) References Cited

U.S. PATENT DOCUMENTS

| | | | | | |
|---|---|---|---|---|---|
| 2,049,278 | A | * | 7/1936 | Toussaint et al. | 52/281 |
| 3,561,182 | A | * | 2/1971 | Madl | 52/479 |
| 5,039,049 | A | * | 8/1991 | Niemi | 248/265 |
| 6,213,679 | B1 | * | 4/2001 | Frobosilo et al. | 403/403 |
| D569,232 | S | * | 5/2008 | Yoshida | D8/355 |

FOREIGN PATENT DOCUMENTS

| | | | |
|---|---|---|---|
| JP | 6-336811 | A | 12/1994 |
| JP | 7-068751 | B2 | 7/1995 |
| JP | 2595429 | Y2 | 3/1999 |
| JP | 2003-328529 | * | 11/2003 |
| JP | 2006-152578 | A | 6/2006 |

* cited by examiner

*Primary Examiner* — Jeanette E Chapman
*Assistant Examiner* — Daniel Kenny
(74) *Attorney, Agent, or Firm* — Birch, Stewart, Kolasch & Birch, LLP

(57) ABSTRACT

A bracket structure for external wall 2 which is excellent in constructability and stability with fixing an external wall, and an external wall construction structure 1 using the bracket for external wall 2. A bracket structure for external wall 2 used for fixing a fiber reinforced cement siding 7, 7' and an outside corner material to a front surface of the wall surface 8 of building via a securing fastening member A, A, A', A', furring 6, 6' and a thermal insulating material placed on a front surface of the wall surface 8 of building.

10 Claims, 6 Drawing Sheets

BRACKET STRUCTURE FOR EXTERNAL WALL AND EXTERNAL WALL CONSTRUCTION STRUCTURE

CROSS-REFERENCE TO RELATED APPLICATIONS

This application clams priority under 35 U.S.C §119(a) to Japanese patent application no. JP 2007-004075U and JP 2007-004076U, filed on May 31, 2007. The contents of this application are incorporated herein by reference in their entirely.

FIELD OF THE INVENTION

The present invention is related to a bracket for external wall and an external wall construction structure using the bracket for external wall. The bracket for external wall used in order to construct the novel external wall surface at an outside corner part of a wall surface of buildings built with reinforced concrete or brick.

DESCRIPTION OF THE REALTED ART

In general, as for a wall surface of buildings of reinforced concrete construction or brick construction, a finish needs not to be given to the surface. However, by a case, the wall surface is coated with a mortar, and a painting is given thereto for finishing a surface. On the other hand, when the wall surface of existing building is repaired with siding board, there is a construction method which it installs in sub stratum materials and furring in an existing wall surface, and fasten in siding board.

However, there are following problems in this siding board construction method.

As for the furring or the furring fixture member, thickness and weight are massive. Therefore, an installation work operation by jib crane is needed. There is a problem that working efficiency is inferior in (patent literature 1).

In addition, there is a problem that a thermal insulating material is not able to be installed in between existing surface of external wall and siding board. There is a problem that thickness of a thermal insulating material are limited to (patent literature 2).

In an outside corner portion of building, there is a similar problem (patent literature 3).

Even more particularly, in the middle of construction, the bed furring strip or L-shape bed plate inclines and rotates. And, there is a problem that construction cannot construct efficiently. There is a problem that the non-land occurs (patent literature 4).

When outside corner material making with materials same as siding board are used, there is a problem to gain trouble of construction. There is a problem that working efficiency is inferior in.

When siding board and outside corner material making with materials same as siding board are fixed with fastening member in right and left joint of siding board and outside corner material making with materials same as siding board, there is a problem construction steps increase. Such a problem may decrease construction productivity.

[Patent Literature 1]

Japanese Utility Model Registration No. 2,595,429

[Patent Literature 2]

Japanese Patent Examined Publication No. H07-68751

[Patent Literature 3]

Japanese Patent Laid-Open No. 2006-152578

[Patent Literature 4]

Japanese Patent Laid-Open No. H06-336811

SUMMARY OF THE INVENTION

The present invention is achieved to solve problems of described above.

The purpose for the present invention is to provide a bracket for external wall having a preferable stability and to improve construction workability with siding board and a thermal insulating material, in the wall surface of outside corner part of building of reinforced concrete construction or brick construction.

And, the purpose of the present invention is to provide the external wall construction structure having preferable stability and construction can be made with siding board and a thermal insulating material, in the wall surface of outside corner part of building of reinforced concrete construction or brick construction.

The object of the present invention mentioned above is achieved by a bracket for external wall used in an outside corner part of wall surface of building, the bracket for external wall comprising:

two sets of first bracket members, two sets of second bracket members, and two sets of bracket member for outside corners.

The object of the present invention mentioned above is effectively achieved by a bracket for external wall in which the first bracket member has a base part and a rising part which is stood forward by the base part, and the second bracket member has a slide part having intercuspation part and a front part which is stood from the slide part to lateral, and further the bracket member for outside corners has a slide part having intercuspation part and a contact part which is stood from the slide part to back direction.

The object of the present invention mentioned above is further effectively achieved by a bracket for external wall in which the second bracket member has a intercuspation part inserted in the rising part of the first bracket member, and the second bracket member has a slide part to which a slide part of the second bracket member and the rising part of the first bracket member are slided each other, and the slide part of the second bracket member and the rising part of the first bracket member are slided each other in the front and back direction without moving rotationally, and the bracket member for outside corners has a intercuspation part inserted in the front part of the second bracket member, and the bracket member for outside corners has a slide part to which a slide part of the bracket member for outside corners and the front part of the second bracket member are slided each other, and the slide part of the bracket member for outside corners and the front part of the second bracket member are slided each other in the right and left direction without moving rotationally.

The object of the present invention mentioned above is further effectively achieved by a bracket for external wall in which the rising part of the first bracket member has a rib which shape is long in the front and back direction, and an edge portion of the intercuspation part of the second bracket member is generally abutted with the rib.

The object of the present invention mentioned above is further effectively achieved by a bracket for external wall in which the front part of the second bracket member has a rib which shape is long in the right and left direction, and an edge portion of the intercuspation part of the bracket member for outside corners is generally abutted with the rib.

The object of the present invention mentioned above is further effectively achieved by a bracket for external wall in which the first bracket member or the second bracket member or the bracket member for outside corners is generally L shape.

The object of the present invention mentioned above is further effectively achieved by a bracket for external wall in which at least the one bracket member for outside corners is fixed to the other bracket member for outside corners facing each other.

The object of the present invention mentioned above is achieved by an external wall construction structure of an outside corner part of building includes a wall surface, a bracket for external wall which is fixed to the wall surface, a furring which is fixed to the bracket for external wall, and a siding board and a outside corner material making with materials same as siding board which are fixed to the furring, comprising:

a bracket for external wall comprises:

two sets of first bracket members, two sets of second bracket members, and two sets of bracket members for outside corners.

The object of the present invention mentioned above is effectively achieved by an external wall construction structure in which the furring is fixed to the bracket member for outside corners and the siding board and the outside corner material making with materials same as siding board are fixed to the furring via a securing fixture or fastening member.

The object of the present invention mentioned above is further effectively achieved by an external wall construction structure in which the first bracket member has a base part and a rising part which is stood forward by the base part, and the second bracket member has a slide part having intercuspation part and a front part which is stood from the slide part to lateral, and further the bracket member for outside corners has a slide part having intercuspation part and a contact part which is stood from the slide part to back direction.

The object of the present invention mentioned above is further effectively achieved by an external wall construction structure in which the base part of the first bracket member is fixed to the wall surface, and the second bracket member has a intercuspation part inserted in the rising part of the first bracket member, and the second bracket member has a slide part to which a slide part of the second bracket member and the rising part of the first bracket member are slided each other in the front and back direction without moving rotationally, and the slide part of the second bracket member and the rising part of the first bracket member are fixed each other, and the bracket member for outside corners has a intercuspation part inserted in the front part of the second bracket member, and the bracket member for outside corners has a slide part to which a slide part of the bracket member for outside corners and the front part of the second bracket member are slided each other in the right and left direction without moving rotationally, and the slide part of the bracket member for outside corners and the front part of the second bracket member are fixed each other, and at least the one bracket member for outside corners is fixed to the other bracket member for outside corners facing each other.

The object of the present invention mentioned above is further effectively achieved by an external wall construction structure in which the rising part of the first bracket member has a rib which shape is long in the front and back direction, and an edge portion of the intercuspation part of the second bracket member is generally abutted with the rib.

The object of the present invention mentioned above is further effectively achieved by an external wall construction structure in which the front part of the second bracket member has a rib which shape is long in the right and left direction, and an edge portion of the intercuspation part of the bracket member for outside corners is generally abutted with the rib.

The object of the present invention mentioned above is further effectively achieved by an external wall construction structure in which the first bracket member or the second bracket member or the bracket member for outside corners is generally L shape.

The object of the present invention mentioned above is further effectively achieved by an external wall construction structure in which the furring is generally hat cross-sectional shape, and the furring has a stationary surface and a clamp face, and the stationary surface of the furring is fixed to the bracket member for outside corners.

Effects of the Invention

According to the bracket for external wall and the external wall construction structure of the present invention, furring and a bracket for external wall to use are lightweight. Therefore, conventional jib crane becomes needless. Even more particularly, construction efficiency improves in construction being enabled with human agency. In addition, size of front and back direction of the bracket for external wall is larger than thickness of a thermal insulating material. The bracket member slides in the front and back direction. Therefore, non-land adjustment is possible by a bracket member. Even more particularly, a bracket member for outside corners slides in the right and left direction. Therefore, positioning is enabled. In other words, location of the whole bracket for external wall can be adjusted in the front and back direction and in the right and left direction. In addition, when a bracket for external wall is constructing, each bracket member is not moved in top and bottom direction. And each bracket member does not incline. A bracket for external wall is stable, and it is built. Even more particularly, by fixing furring to a bracket for external wall adjusted the non-land to, the siding board such as fiber reinforced cement siding is constructed without the non-land, and fastens efficiently, and stability is preferable.

Thus, according to the bracket for external wall and the external wall construction structure of the present invention, it is lightweight, and construction fastens efficiently without the non-land, and stability is preferable, and it can construct. Its usefulness quite is high.

DENOTATION OF REFERENCE NUMERALS

Figure 1:
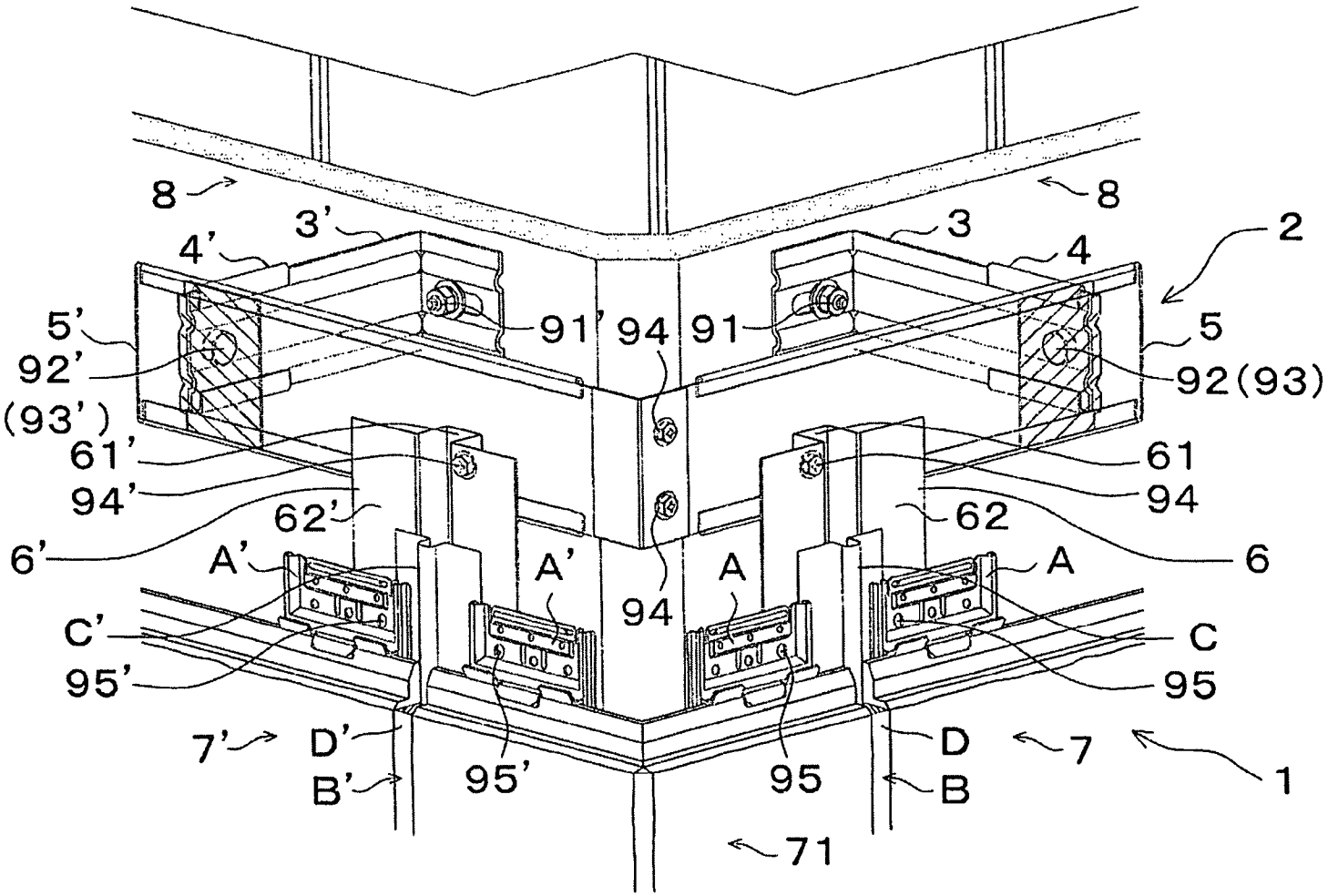
FIG. 1 is perspective view which shows a bracket for external wall and external wall construction structure of embodiment.

1 External wall construction structure.
2 Bracket for external wall.
3, 3' First bracket member.
31, 31' Base part of the first bracket member.
311, 311' Elongate opening of the base part 31 of the first bracket member 3.
32, 32' Rising part of the first bracket member 3.
321, 321' Opening of the rising part 32 of the first bracket member 3.
4, 4' Second bracket member.
41, 41' Slide part of the second bracket member 4.
411, 411' Intercuspation part of the slide part 41 of the second bracket member 4.
412, 412' Elongate opening of the slide part 41 of the second bracket member 4.
42, 42' Front part of the second bracket member 4.
43, 43' Corner of the second bracket member 4.
5, 5' Bracket member for outside corners.
51, 51' Slide part of the bracket member 5 for outside corners.
511, 511' Intercuspation part of the slide part 51 of the bracket member 5 for outside corners.
52, 52' Contact part of the bracket member 5 for outside corners.
6, 6' furring.
61, 61' Stationary surface of the furring 6.
62, 62' Clamp face of the furring 6.
63 Face to stand of the furring 6.
64 Turned edge part of the furring 6.
7, 7' Fiber reinforced cement siding (siding board).
71 Outside corner material making with materials same as siding board.
72, 72' Lower tongue.
73, 73' Upper tongue.
8 Wall surface.
9, 9' Fixture.
91, 91' hole-in anchor
92, 92' bolt.
93, 93' Nut.
94, 94' Screw.
95, 95' Screw for metal fitting.
A, A' Fastening member.
B, B' Longitudinal joint portion.
C, C' Hat joiner.
D, D' Waterproofing material.
E, E' Rib.
F, F' Rib.
G Rib.
H, H' Rib of the furring 6.

DETAILED DESCRIPTION OF THE PREFERRED EMBODIMENTS

Figure 2:
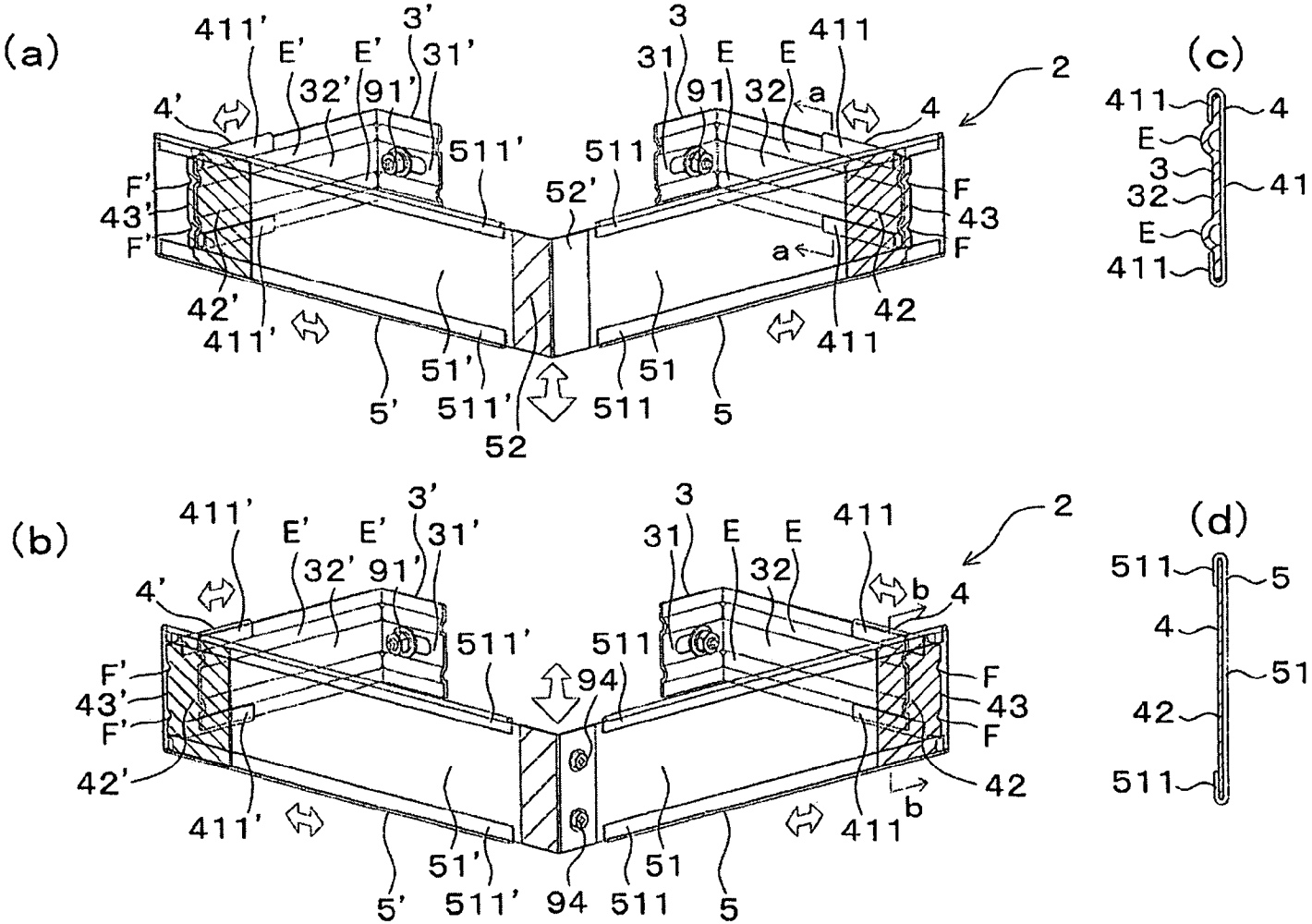
FIG. 2 is a bracket for external wall of embodiment, (a) perspective view 1, (b) perspective view 2, (c) a-a sectional drawing, (d) b-b sectional drawing.
Figure 3:
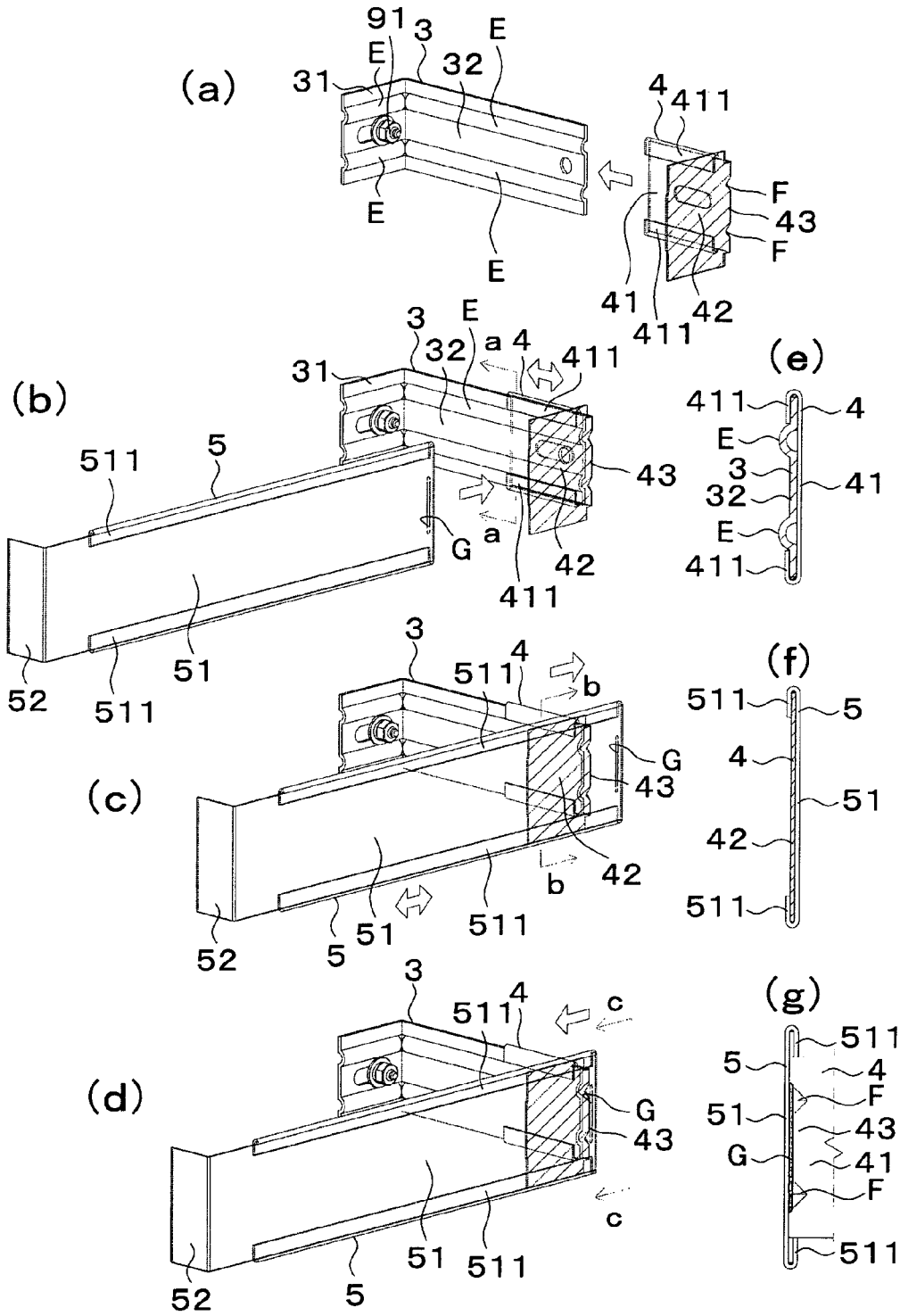
FIG. 3 shows one part of a bracket for external wall of embodiment, (a) perspective view 1, (b) perspective view 2, (c) perspective view 3, (d) perspective view 4, (e) a-a sectional drawing, (f) b-b sectional drawing, (g) c-c side view.
Figure 4:
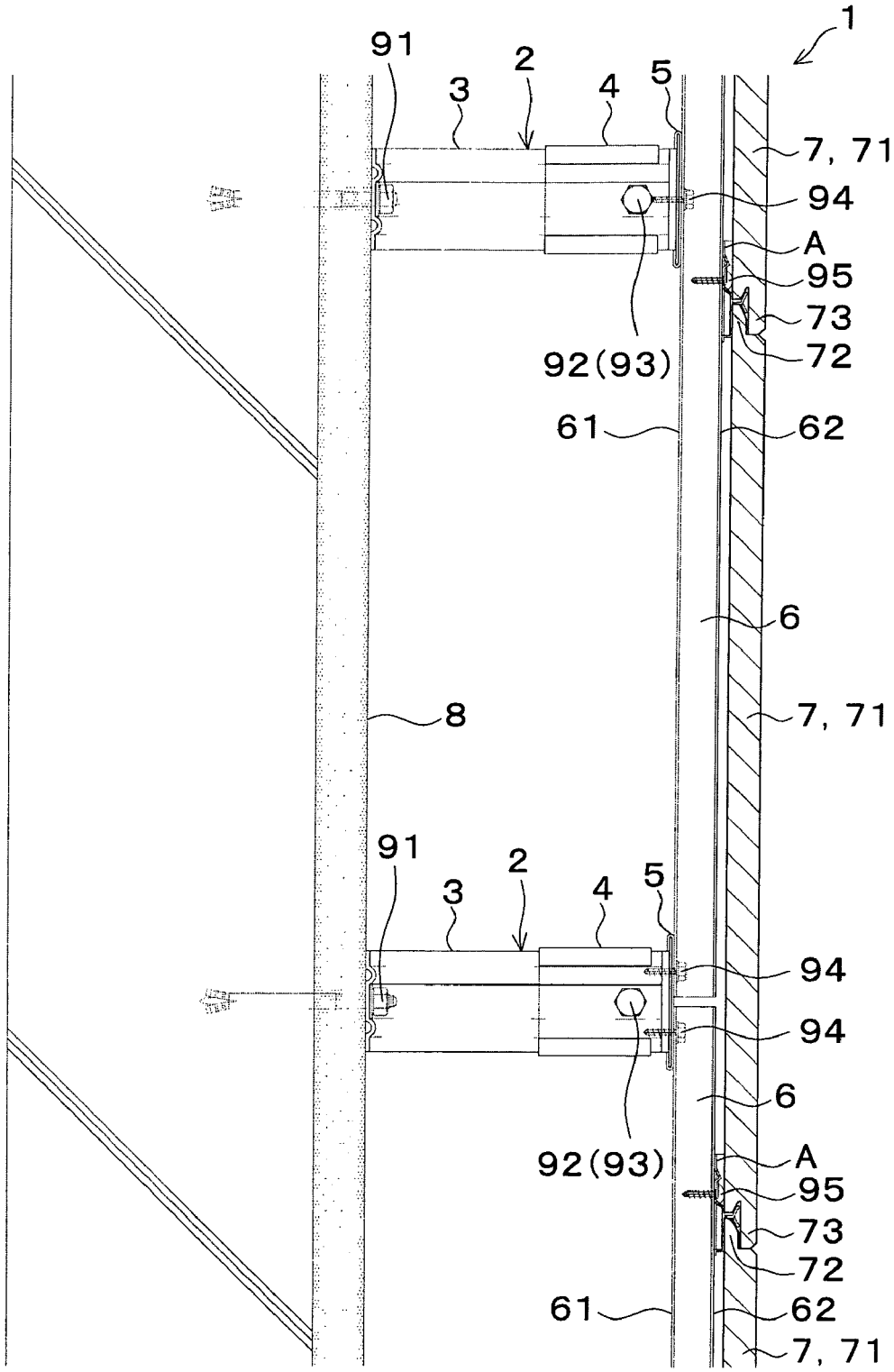
FIG. 4 is a vertical sectional view which shows a bracket for external wall and external wall construction structure of embodiment.
Figure 5:
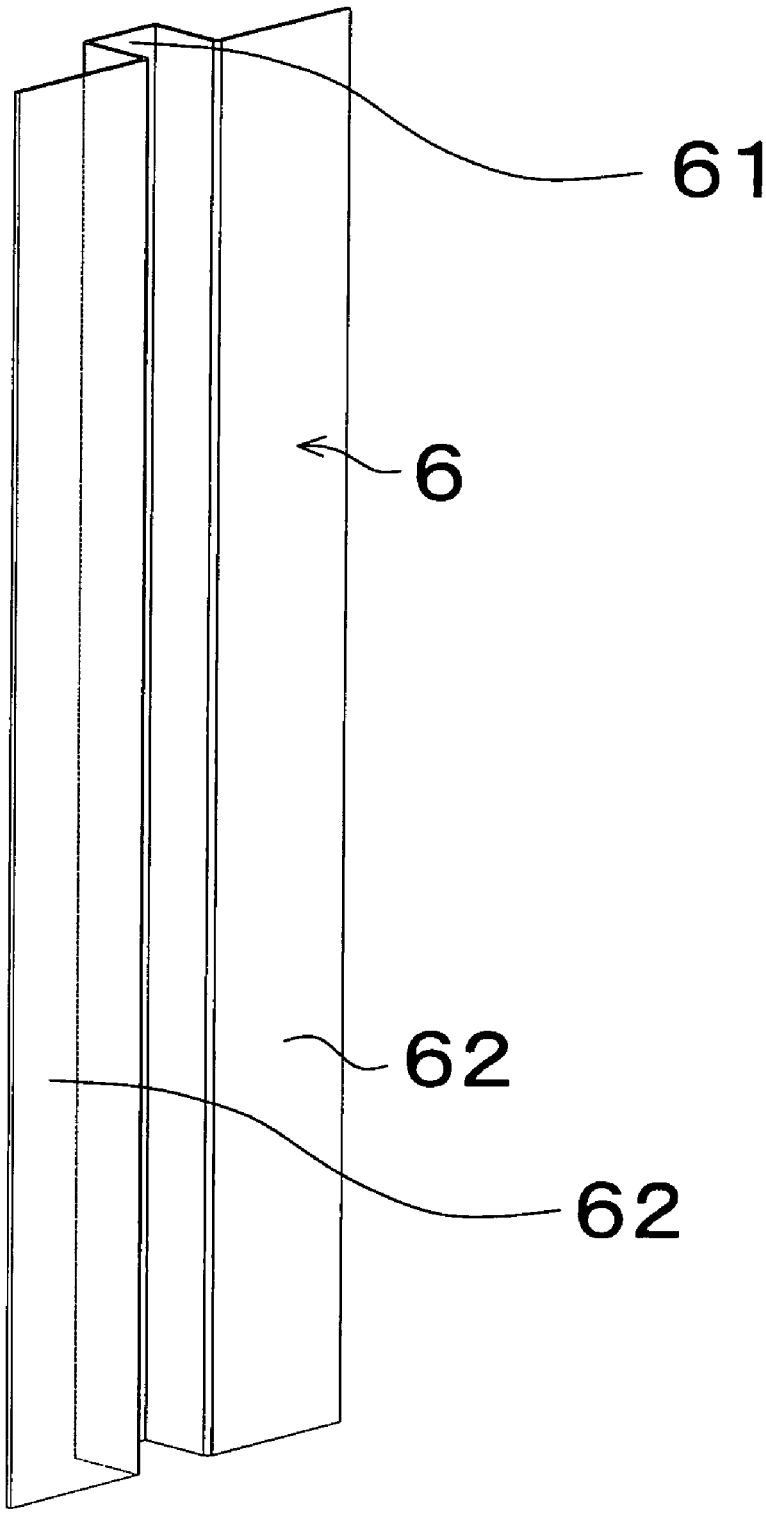
FIG. 5 shows perspective view of the furring which is one part of external wall construction structure of embodiment.
Figure 6:
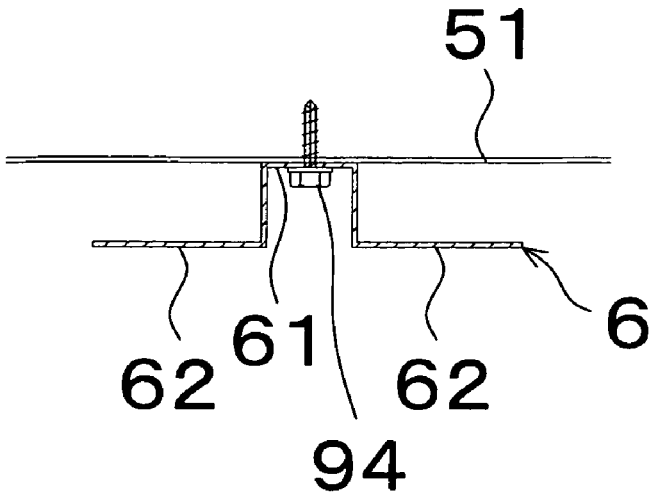
FIG. 6 shows a horizontal sectional view of furring and the bracket member for outside corners which are one part of external wall construction structure of embodiment.
Figure 7:
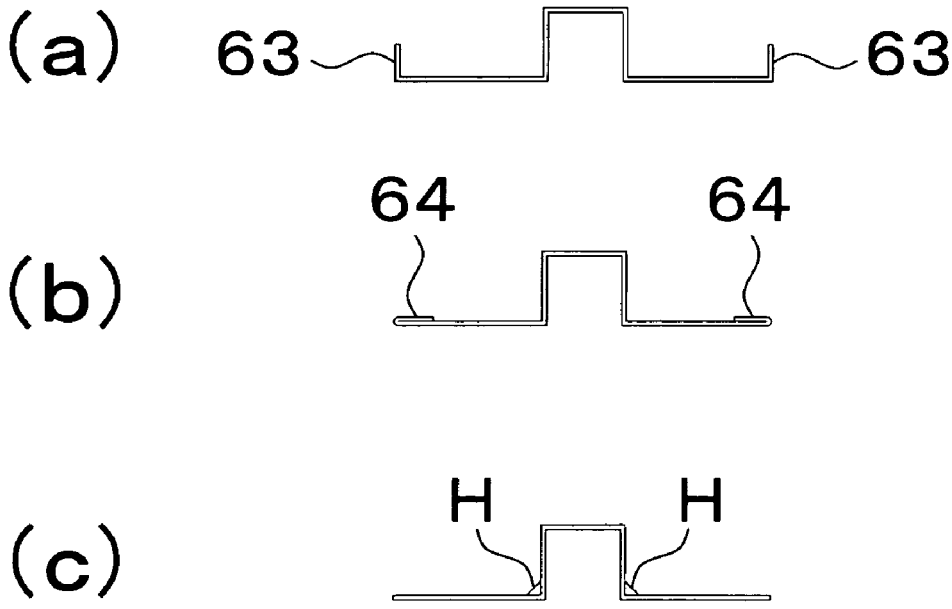
FIG. 7 shows a shape change example of the furring that is one part of external wall construction structure of embodiment, (a) sectional drawing 1, (b) sectional drawing 2, (c) sectional drawing 3.

The best embodiments of the present invention will be described with reference to FIG. 1 to FIG. 7. FIG. 1 and FIG. 4 show a bracket for external wall and external wall construction structure in detailed description of the preferred embodiment. FIG. 2, FIG. 3 show an one part of a bracket for external wall in detailed description of the preferred embodiment. FIG. 5 and FIG. 6 show a furring used in external wall construction structure in detailed description of the preferred embodiment. FIG. 7 shows shape change example of the furring used in external wall construction structure in detailed description of the preferred embodiment.

In this specification, the term "front" denotes "outer side of building", "back" denotes "inner side of building". Moreover, regarding the above bracket for external wall and other components, expressions such as "front", "back", "above/up/upper/top", "below/down/lower/bottom", "horizontal" and "vertical", are used in a state where the bracket for external wall is being fixed to the wall surface. As for "left" and "right" denotes "on the observer's left/right who is facing the outer side of an external wall".

Embodiment 1

As shown in FIG. 1, external wall construction structure 1 is construction structure of an outside corner part of building. External wall construction structure 1 is constructed with bracket for external wall 2 and with furring 6, 6' and with fiber reinforced cement siding 7, 7' and with outside corner material making with materials same as siding board 71.

The bracket for external wall 2 is constructed with the first bracket member 3, 3' of cross-sectional shape of form of generally L, and with the second bracket member 4, 4' of cross-sectional shape of form of generally L, and with bracket member 5, 5' for outside corner of cross-sectional shape of form of generally L. A bracket for external wall 2 is fixed more to wall surface 8 such as reinforced concrete or a brick by hole-in anchor 91, 91'. The first bracket member 3, 3' and the second bracket member 4, 4' are fixed each other with bolt 92, 92' and nut 93, 93'. In addition, he bracket members 5, 5' for outside corners are fixed each other with screw 94, 94'.

Even more particularly, furring 6, 6' of cross-sectional shape of form of generally hat-shaped is fixed in the bracket member 5, 5' for outside corners of bracket for external wall 2 with screw 94, 94' and, fiber reinforced cement siding 7, 7' and outside corner material making with materials same as siding board 71 are fixed to furrings 6, 6' with screws 95, 95, 95', 95' for metal fitting and fastening member A, A, A', A'.

In addition, hat joiner C, C' are installed behind longitudinal joint portion B, B' formed right and left joint portion gap between fiber reinforced cement siding 7, 7' and outside corner material making with materials same as siding board 71. Waterproofing material D, D' such as wet process sealing materials are cast by longitudinal joint portion B, B'.

In addition, in accordance with exemplary embodiments, a thermal insulating material constructed between wall surface 8 and fiber reinforced cement siding 7, 7' omits daringly to make a joint condition of member subject clear.

As shown in FIG. 2 (*a*), (*b*), bracket for external wall 2 is comprised each bracket member. Each bracket member mutual intercuspation part is inserted in bracket for external wall 2 each other. (described below). Therefore, bracket for external wall 2 moves slidably in the direction of the front, back, left and right. Therefore, as against the non-land of wall surface 8, bracket for external wall 2 can speak centering control. In other words, the second bracket member 4, 4' moves slidably in the front and back direction. And the bracket member 5,5' for outside corners moves slidably in the right and left direction (horizontal direction).

In addition, even though bolt 92, 92' is not fully tighten, bracket for external wall 2 does not incline to lower direction. And bracket for external wall 2 does not move in top and bottom (vertical) direction. Bracket for external wall 2 can adjust position in the direction of the front, back, left and right in stabile state.

In addition, though contact part 52' of bracket member 5' for one outside corners is fixed with screw 94,94 in slide part 51 of bracket member 5 for outside corners facing each other, external wall substrate member 2 moves in the direction of the front, back, left and right.

The second bracket member 4, 4' has intercuspation part 411, 411, 411', 411' in the upper end and the lower end of the slide part 41,41'. The intercuspation region 411,411,41 1', 41 1' are inserted and abutted to the rising part 32, 32' of the first bracket member 3. Therefore, the second bracket member 4, 4' moves in the front and back direction. However, the second bracket member 4, 4' does not move in the top and bottom direction. And the second bracket member 4, 4' does not rotate.

Even more particularly, the second bracket member 4, 4' moves slidably because edge portion of intercuspation part 411, 411, 411', 411' are generally abutted by rib E, E, E', E' of the first bracket member 3, 3' respectively. And the second bracket member 4, 4' move slidably because intercuspation part 411, 411, 411', 411' are guided rib E, E, E', E'.

In addition, when an external force of the vertical direction is transmitted to bracket for external wall 2, the second bracket member 4, 4' does not decline in the vertical direction. And the second bracket member 4, 4' does not rotate. If why is, the reason is because edge portion of intercuspation region 411, 411, 411', 411' of the second bracket member 4, 4' are generally abutted by rib E, E, E', E' of the first bracket member 3, 3' respectively.

Similarly, a bracket member 5, 5' for outside corners has intercuspation part 511, 511, 511' ,511' on the slide part 51, 51' in the lower end, too. Intercuspation part 511, 511, 511', 511' are abutted with the front part 42, 42' of second bracket member 4, 4' and are inserted. Therefore, the bracket member for outside corners 5,5' moves in the right and left direction. However, bracket member for outside corners 5, 5' does not move in vertical direction. And bracket member for outside corners 5, 5' does not rotate.

In addition, in accordance with exemplary embodiments, the second bracket member 4, 4' has rib F, F, F', F' for reinforcementin in corner 43, 43' of the second bracket member 4, 4'.

In addition, same as described above, the second bracket member 4, 4' are able to have a rib in the fornt part 42, 42' of the second bracket member 4, 4' in the left-and right -direction (horizontal direction). And it is able to make edge portion of intercuspation part 511, 511, 511', 511' of bracket member 5, 5' for outside corners, generally abut with those rib again respectively. For this case, bracket member 5, 5' for outside corners moves slidably. It is effective in preventing from inclining and rotating.

When, in the construction order as shown in FIG. 3 (*a*), (*b*), (*c*), to the first, second bracket member 4 is abutted rising part 32 of the first bracket member 3. And it is inserted. To the second, bracket member for outside corners 5 is abutted front part 42 of second bracket member 4. And it is inserted.

Firstly, anteroposterior non-land regulation of the second bracket member 4 may be performed. The second bracket member 4 is fixed to the first bracket member 3 next. The positioning that bracket member for outside corners 5 will be adjustable later in the horizontal direction.

Each bracket member does not incline even if there is each bracket member in the middle of construction. And, it does not rotate. In addition, it is assumed more that other bolt except hole-in anchor 91 was temporary fatal blow state, and each bracket member does not incline. And, it does not rotate.

Slide part 51 of bracket member for outside corners 5 does not have protruding things such as screws. Furring 6 is fixed without the non-land in a free location of slide part 51 of bracket member for outside corners 5 comprising external wall substrate member 2 (cf. FIG. 1). Face 42 needs not to be fixed with screws before bracket member 4 of slide part 51 of bracket member for outside corners 5 and the second each other. However, when strength of the whole external wall substrate member 2 is improved more, what thereof is a slide adjustment screw, and is fixed is desirable.

In addition, as shown in FIG. 3(*b*), rib G may be installed in convexity stria to a posterior side of right side edge of slide part 51 of bracket member for outside corners 5. Thanks to rib G, bracket member for outside corners 5 is not left out of the second bracket member 4. Rib G has an effect to prevent a coming out omission. Intercuspation region 511,511 of bracket member for outside corners 5 are inserted in face 42 before the second bracket member 4, and, as shown in FIG. 3(*c*), bracket member for outside corners 5 is moved in the right side. As shown in FIG. 3(*d*), location of rib G of bracket member for outside corners 5 reaches the right side from corner 43 of the second bracket member 4. Then, when bracket member for outside corners 5 is moved by left side, rib G is abuted corner 43. Therefore, bracket member for outside corners 5 is not moved in the left direction. In other words, bracket member for outside corners 5 is inserted in the second bracket member 4. Bracket member for outside corners 5 is moved for a long time once in the right side. Bracket member for outside corners 5 is not divided from the second bracket member 4 easily. A constructing coming out omission of bracket member for outside corners 5 can be prevented because rib G is provided with. A duty of construction improves.

As shown in FIG. 4, lot of bracket for external wall 2 open spacing in top and bottom direction, and they are fixed to wall surface 8 with lot of hole-in anchor 91. Furring 6, 6' are fixed to bracket member outside corners 5 of lot of bracket for external wall 2 with lot of screws 94.

Even more particularly, Lower tongue 72 is formed in the upper end surface of lot of fiber reinforced cement siding 7 and outside corner material making with the same materials as siding board 71. In a similar manner, in the lower end side, upper tongue 73 corresponding to lower tongue 72 is formed. Fastening member A is engaged to lower tongue 72 in the upper end surface of lot of fiber reinforced cement siding 7 and outside corner material making with the same materials as siding board 71. This fastening member A is fixed to clamp face 62, 62 of furring 6, 6 with screw 95 for metal fitting. In addition, as against lower tongue 72 of this upper end surface, upper tongue 73 of the lower end face of epistatic fiber reinforced cement siding 7 and outside corner material making with materials same as siding board 71 are engaged and mounted. (cf. FIG. 1)

In addition, as shown in FIG. 5, furring 6 is made by bending a steel plate of a predetermined dimension, and furring 6 is machined. As for furring 6, cross-sectional shape is form of generally hat. Furring 6 is a long object. Furring 6 has flat stationary surface 61 and clamp face 62 which are protruded forward than stationary surface 61 and are parallel to stationary surface 61. Furring 6 can be made light-weight by doing in the shape of generally hat. In addition, air space for anteroposterior thickness of furring 6 can be secured so that clamp face 62 are located forward than stationary surface 61.

As shown in FIG. 6, stationary surface 61 of furring 6 is abutted slide part 51 of bracket member 5 for outside corners. Furring 6 is fixed to bracket member 5 for outside corners with screw 94. As for the shape of furring 6, screw 94 does not protrude than clamp face 62. All the extension face of clamp face 62 are flat because screw 94 does not protrude. When fiber reinforced cement siding 7 is fixed to clamp face 62 of furring 6 with fastening members, screw 94 and clamp face 62 do not interfere. It can be constructed furring 6 without the non-land. In addition, in a state where the other screw is fixed to bracket member 5 for outside corners, the shape of furring 6 can reduce interference of this other screw and clamp face 62.

Even more particularly, as for furring 6, clamp face 62 is parallel to stationary surface 61 each other. Therefore, when external force is acted on clamp face 62, furring 6 can absorb external force easily, because of furring 6 is done elastic deformation. In other words, furring 6 can absorb external of force front and back direction and left and right direction. The external force of front and back direction and a left and right direction is the wind pressure that transmitted from fiber reinforced cement siding 7, 7' and so on. As a result, total stability improves at the time of a state that siding etc. are fixed.

FIG. 7(*a*), (*b*), (*c*) are shape change example of furring 6 comprising one part of embodiment of the present invention. Face 63 to stand and turned edge part 64 and rib H can improve strength without losing weight saving of furring 6.

Concerning structural building frame of external wall construction structure of the present invention, it was done for reinforced concrete construction and building in brick, and was explained like statement above mainly. It can be applied about structure except these likewise structural building frame. If an example is given, structural building frame is masonry structure such as a stone construction and a concrete-block construction or ALC (autoclaved lightweight concrete) block construction. In addition, it can be applied for wall surface of ALC board external wall construction structure of the present invention.

A siding board was explained using fiber reinforced cement siding. Siding board is worthy of external forces such as earthquake or a typhoon, if it is like flat plate, any kind of siding board is preferable. If an example of siding board except fiber reinforced cement siding is given, there are metal siding, complex metal genus siding, extrusion cement plate, burnt board (earthenware board, ceramic board), calcium silicate board. In addition, clay tile or stone material were attached, the siding board may have coupled fiber reinforced cement siding or metal siding as substrate to thereof When strength or durability of a bracket for external wall are considered, a material of a bracket for external wall made of iron, hot dip galvanized steel plate or stainless steel plate are preferable. A bracket for external wall made by bending a metal plate is preferable. And a thickness of the plate to form the bracket for external wall is preferably such as the bracket for external wall can hardly be broken or deformed when an external force is transmitted. When it is shown to that example, 1.2 mm or more in the case of metal plate such as iron is preferable.

As for the shape with the first bracket member and the second bracket member and a bracket member for outside corners, there is T-shaped shape besides L-form. Shape having the dimension that can find space disposing a thermal insulating material is desirable for shape of each bracket member. And it is prefrable that shape has strength enough. And it is prefrable to include a slide part having intercuspation part in shape. And slidable shape is preferable. And if each bracket member can be fixed each other, shape of each bracket member may be any kind of convex shape.

Even more particularly, it is preferable for each bracket member to be fixed by fixture such as a bolt, a nut, a screw. In addition, thereof in the case of material of each bracket member made by iron, it is preferable for each bracket member to be fixed each other by welding.

The material of furring is made of wood, metal, and resin. If material of furring has strength for wind pressure enough, material of furring is preferable with any kind of thing. And when it is supposed that material of furring is solid and does not transform easily, material of furring is preferable with any kind of thing. As for the material of furring, a product made in metal or a wooden article is desirable.

Even more particularly, rectangular cross sections are given to cross-sectional shape of furring besides shape shown to in embodiment. If strength for wind pressure is enough, cross-sectional shape of furring is preferable in any kind of shape. And if it is to be the shape which is not transformed easily, shape of furring is preferable in any kind of shape. When it is supposed that furring is made of wood, as for the shape of furring, a rectangular cross section is desirable. When it is supposed that it is made of metal, generally hat that weight saving is possible-shaped profile is desirable. When furring is fixed to a bracket for external wall, in the edge of upper and bottom part of furring, between end face and end face of each furring provided with clearance is desirable.

What is claimed is:

1. A bracket structure for an external wall used at an outside corner part of the wall surface of a building, comprising:

two first bracket members each of which has a base part and a rising part so that the base part and the rising part form a L-shape, two second bracket members, each of which has a slide part into which the rising part of the first bracket can be inserted and a front part so that the slide part and the front part form a L-shape, and two third bracket members for an outside corner, each of the third bracket member has a sliding part into which the front part of the second bracket can be inserted and a contact part, wherein the rising part of each of the first bracket member is inserted into the slide part of each of the second bracket member so that the rising part of the first bracket member is slidably but nonrotatably connected to the slide part of the second bracket member, the front part of each of the second bracket is inserted into the sliding part of each of the third bracket member so that the front part of the second bracket is slidably but nonrotatably connected to the sliding part of the third bracket member, and the contact part of the third bracket member is fixed to the contact part of the other third bracket member, wherein the rising part of the first bracket member has a rib extending in a direction in which the rising part of the first bracket member is inserted into the slide part of the second bracket member, and the slide part of the second bracket member has an edge portion in longitudinal direction so that the edge portion slidably hold the rising part of the first bracket member and generally contact with the rib of the first bracket member, and the front part of the second bracket member has a rib extending in a direction in which the front part of the second bracket member is inserted into the slide part of the third bracket member, and the slide part of the third bracket member has an edge portion in longitudinal direction so that the edge portion slidably hold the front part of the second bracket member and generally contact with the rib of the second bracket.

2. The bracket structure for external wall as claimed in claim 1, wherein the third bracket member has the sliding part and the contact part so that the sliding part and the contact part form a L-shape.

3. The bracket structure for external wall as claimed in claim 1, wherein the contact part of the third bracket member is fixed to the contact part of the other third bracket member with a screw.

4. The bracket structure for external wall as claimed in claim 1, wherein the third bracket members are fixed at a substantially right angle.

5. An external wall construction structure of an outside corner part of building comprising:

a wall surface;

a bracket for an external wall which is fixed to the wall surface;

a furring which is fixed to the bracket for an external wall; and a siding board forming a outside corner, wherein the bracket for an external wall comprises:

two first bracket members, each of which has a base part and a rising part so that the base part and the rising part form a L-shape;

two second bracket members, each of which has a slide part into which the rising part of the first bracket can be inserted and a front part so that the slide part and the front part form a L-shape; and two third bracket members for an outside corner, each of the third bracket member has a sliding part into which the front part of the second bracket can be inserted and a contact part, wherein the rising part of each of the first bracket member is inserted into the slide part of each of the second bracket member so that the rising part of the first bracket member is slidably but nonrotatably connected to the slide part of the second bracket member, the front part of each of the second bracket is inserted into the sliding part of each of the third bracket member so that the front part of the second bracket is slidably but nonrotatably connected to the sliding part of the third bracket member, and the contact part of the third bracket member is fixed to the contact part of the other third bracket member, the base part of the first bracket member is fixed to the wall surface, the rising part of the first bracket member is fixed to the slide part of the second bracket members;

the slide part of the third bracket member is fixed to the front part of the second bracket member, and the furring is fixed to the slide part of the third bracket member, and the siding board is fixed to the furring via a securing fixture or fastening member.

6. The external wall construction structure as claimed in claim 5, wherein the rising part of the first bracket member has a rib extending in a direction in which the rising part of the first bracket member is inserted into the slide part of the second bracket member, and the slide part of the second bracket member has an edge portion in longitudinal direction so that the edge portion slidably hold the rising part of the first bracket member and generally contact with the rib of the first bracket member, and the front part of the second bracket member has a rib extending in a direction in which the front part of the second bracket member is inserted into the slide part of the third bracket member, and the slide part of the third bracket member has an edge portion in longitudinal direction so that the edge portion slidably hold the front part of the second bracket member and generally contact with the rib of the second bracket.

7. The external wall construction structure as claimed in claim 5 or 6, wherein the third bracket member has the sliding part and the contact part so that the sliding part and the contact part form a L-shape.

8. The external wall construction structure as claimed in claim 5 or 6, wherein the furring is generally hat cross-sectional shape, and the furring has a stationary surface and a clamp face, and the stationary surface of the furring is fixed to the third bracket member.

9. The external wall construction structure as claimed in claim 7, wherein the furring is generally hat cross-sectional shape, and the furring has a stationary surface and a clamp face, and the stationary surface of the furring is fixed to the third bracket member.

10. The external wall construction structure as claimed in claim 5, wherein the third bracket members are fixed at a substantially right angle.

* * * * *